US005451732A

United States Patent [19]

Cayron et al.

[11] Patent Number: 5,451,732

[45] Date of Patent: Sep. 19, 1995

[54] SELECTION AND/OR ADJUSTMENT BUTTON, IN PARTICULAR FOR A FRONT PANEL ON BOARD AN AIRCRAFT

[75] Inventors: Dominique Cayron, Paris; Jean-Jacques Pelliser, Clichy, both of France

[73] Assignee: Societe de Telecommunications, Electronique Aeronautique et Maritime (TEAM), Rungis, France

[21] Appl. No.: 124,041

[22] Filed: Sep. 21, 1993

[30] Foreign Application Priority Data

Sep. 21, 1992 [FR] France ..... 92 11202

[51] Int. Cl.[6] ..... H01H 9/18

[52] U.S. Cl. ..... 200/314; 200/312

[58] Field of Search ..... 200/310, 312, 313, 314, 200/315, 316, DIG. 47

[56] References Cited

U.S. PATENT DOCUMENTS

| | | | |
|---|---|---|---|
| 2,699,141 | 1/1955 | Gaguski | 200/DIG. 47 |
| 3,144,643 | 8/1964 | Andersson | 200/314 X |
| 3,588,420 | 6/1971 | Conrad | 200/DIG. 47 |
| 3,755,661 | 8/1973 | Bouvrande | 200/DIG. 47 |
| 4,131,777 | 12/1978 | Bailey . | |
| 4,987,279 | 1/1991 | Hirose | 200/314 |

FOREIGN PATENT DOCUMENTS

| | | | |
|---|---|---|---|
| 526838 | 7/1992 | European Pat. Off. . | |
| 1081958 | 5/1960 | Germany | 200/312 |
| 2803539 | 8/1979 | Germany | 200/314 |
| 4253119 | 9/1992 | Japan | 200/313 |

*Primary Examiner*—Renee S. Luebke

*Attorney, Agent, or Firm*—Sixbey, Friedman, Leedom & Ferguson; Gerald J. Ferguson, Jr.; Tim L. Brackett

[57] ABSTRACT

The invention relates to a selection and/or adjustment button mounted on a front panel, the button being of the type constituted by a translucent body having a front face which is illuminated when the front face is illuminated from the inside. The button is provided with a non-translucent contrast piece that forms a reflective front surface that provides significant contrast relative to the front panel in full sunlight, and that delimits the outline of the front face of the button in front view. For example, the contrast piece may be constituted by a fillet or chamfer interconnecting two geometrically similar portions of the button body, whereby the contrast piece is visible only when the button is not pushed in.

5 Claims, 3 Drawing Sheets

SELECTION AND/OR ADJUSTMENT BUTTON, IN PARTICULAR FOR A FRONT PANEL ON BOARD AN AIRCRAFT

The invention relates to selection and/or adjustment buttons mounted on a front panel, in particular the front panel of an equipment case or box on board an aircraft.

BACKGROUND OF THE INVENTION

In aviation, it is common to use boxes having selection and/or adjustment buttons, in particular in the cabin for selecting communications channels and/or for adjusting the corresponding volume level. There are thus on/off selection buttons, adjustment selection buttons, potentiometer-type adjustment buttons, transient contact buttons, or adjustment and transient contact buttons. To an ever-increasing extent, even when the buttons are designed for performing potentiometer-type adjustments, they are of the pushbutton type, thereby making it easy to distinguish the selected and the non-selected positions of each button.

In general, the selection and/or adjustment buttons used are constituted by a translucent body having a front face which is illuminated when light is being conveyed in the thickness of the front panel.

In the particular case of boxes for use on board aircraft, and in particular the cockpit, as much as possible is done to make it easy to identify buttons so that the user can select the appropriate button quickly and without effort.

The greater the contrast coefficient, the easier such identification becomes, where the coefficient is defined by the ratio $(L_B-L_F)\times 1/L_F$ where $L_B$ designates the luminance of a point on the button and $L_F$ designates the luminance of a point on the front panel. The luminance at a point is generally measured by means of a spectrophotometer associated with a computer, the average being taken of measurements performed on a plurality of points on an object (the lower the luminance, the larger the number of points required).

Given the practical difficulty of including illumination within a button itself (because of limited space and high cost, and because of problems of heating), it is common practice to illuminate a button from within the thickness of the front panel, with the front face of the front panel and the visible portion of the side surface being painted (generally black, gray, or dark blue) so that the light inside the front panel cannot escape, thereby making it possible to illuminate only the front faces of buttons thus causing them to stand out more clearly from the front face of the front panel. In the increasingly common circumstance of pushbuttons, proposals have been made to attenuate the illumination of the front face of a button when it is pushed-in by using a narrow passage for diffusing light where the button passes through the front panel in association with a white-painted ring on the body of the button, said ring being located away from the narrow passage when the button is in its non-pushed-in position (button non-selected) and blocking said passage when the button is in its pushed-in position (button selected).

Using such a system, it has been possible to achieve nighttime contrast values of greater than 5, which is acceptable, however daytime contrast values in full sunlight remain poor (on average less than 1.5). Measurement is generally performed using a source providing a light intensity or illumination of 90,000 lux to 100,000 lux, at a specified incidence and distance.

Attempts have been made to improve the "full sunlight" daytime situation by providing a white collar on the body of the button that is visible from the side when the button is in its non-pushed-in position and that disappears when the button is pushed in. However, the contrast obtained is insignificant (i.e. not measurable) when the button is seen from in front under conditions of full sunlight contrast, such that results are still not satisfactory in such a situation.

OBJECTS AND SUMMARY OF THE INVENTION

The present invention seeks specifically to solve that problem by designing a button that is more effective and that does not present the above-mentioned limitations and/or drawbacks.

Thus, an object of the invention is to provide a selection and/or adjustment button whose structure makes it possible to obtain satisfactory contrast values when seen from in front in full sunlight, in particular values that are greater than 5 relative to a gray background and greater than 12 relative to a black background.

Another object of the invention is to provide a selection and/or adjustment button whose contrast performance is independent of the shape of the button, regardless of whether the button is of the pushbutton type or not, and that also remains long-lasting over time.

More particularly, the present invention provides a selection and/or adjustment button mounted on a front panel, in particular the front panel of an equipment box on board an aircraft, said button being constituted by a translucent body having a front face that is illuminated when the front panel is illuminated internally, wherein it is provided with a non-translucent contrast piece, said piece forming a reflecting front surface that provides significant contrast relative to the front panel in full sunlight, and that delimits the front face of the button when seen from in front.

In a first embodiment, the contrast piece is received in an associated groove provided in the front face of the button, said piece then delimiting a central zone of said front face which is illuminated when the front panel is illuminated internally.

The contrast piece received in the front face of the button may itself have a flat annular front face that stands slightly proud of the front face of the button, or in avariant it may have a flat annular front face that is flush with the front face of the button.

It is also advantageous for the contrast piece received in the front face to have an external outline of the same shape as the front face of the button, and in particular an outline that is square or circular, and to have an internal outline that is rounded, in particular an outline that is oval or circular.

Also advantageously, the contrast piece received in the front face is made of a strong material that is pale in color, in particular that is white, which material may be polytetrafluorethylene.

Also preferably, the translucent body is externally coated apart from the central zone of its front face in a white undercoat and in a dark top coat, in particular a coat that is black, gray, or blue.

When the button is of the pushbutton type, it is also advantageous for the body of the button to have a peripheral collar in the vicinity of the front face of the button, said collar being of the same color as the contrast piece received in the front face, said collar being apparent when the button is not pushed in and being hidden when said button is pushed in.

In particular, for a button of the pushbutton type which is also mounted to rotate to perform potentiometer-type adjustments, it is advantageous for the contrast piece received in its front face to have a spot hole or a radial cutout receiving a dark filler material, in particular a black material, to facilitate identifying the angular position of said button.

In another embodiment of the invention, the contrast piece is not received in the front face of the button, but is constituted by a connection surface between two portions of the translucent body that are geometrically similar in section, with the smaller section portion extending forwards, said connection surface being coated in a white top coat, said piece being visible when the button is not pushed and being hidden when said button is pushed in.

It is then preferable for the connection surface constituting the contrast piece to form a fillet or a chamfer.

It is also advantageous for the body of the button to have, in the immediate vicinity of the contrast piece, a peripheral collar of the same color as the contrast piece, said collar being visible when the button is not pushed in and being hidden when said button is pushed in. In particular, the peripheral collar may comprise two portions on respective sides of the contrast piece.

In a variant, the contrast piece is defined by a white ring surrounding the body of the button and projecting from the side face of said body, said ring being visible when the button is not pushed in and being hidden when said button is pushed in.

It is then advantageous for the body of the button to have a circumferential groove receiving a portion of the ring that defines the contrast piece, which ring is preferably round in section and made of a silicone elastomer.

It is also advantageous for the body of the button to have, in the direct vicinity of the ring defining the contrast piece, a peripheral collar of the same color as the contrast piece, said collar likewise being visible when the button is not pushed in and being hidden when said button is pushed in.

Finally, in particular, when using a contrast piece formed by a connection surface or by a projecting ring, it is also possible to implement a pushbutton type of button which is also mounted to rotate for potentiometer-type adjustment: it is then advantageous for the front face of the button to be constituted by an insert received in the button, which insert has a radial groove receiving a filler of pale color, in particular white, to facilitate identifying the angular position of said button.

BRIEF DESCRIPTION OF THE DRAWINGS

Other characteristics and advantages of the invention appear more clearly in the light of the following description of particular embodiments given with reference to the figures of the accompanying drawings, in which.

MORE DETAILED DESCRIPTION

With reference to FIGS. 1 to 5, the description begins with a first embodiment of the invention in the form of a pushbutton-type selector button that is square in section.

Figure 1:
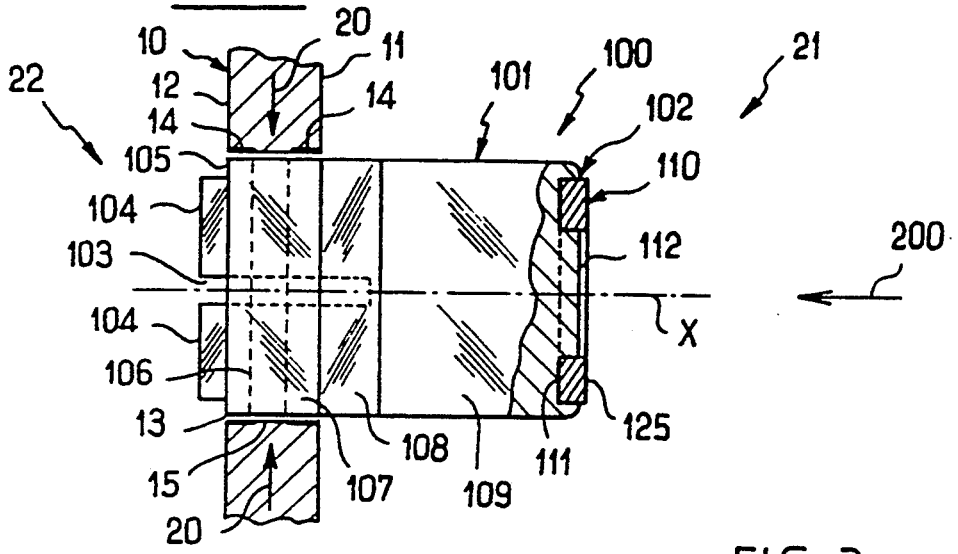
FIG. 1 shows a selector button in accordance with the invention, the button being of the pushbutton type in this case and being square in section (the partially cutaway front portion of the button serves to show more clearly the contrast piece which in this case is received in the front panel of said button)
Figure 2:
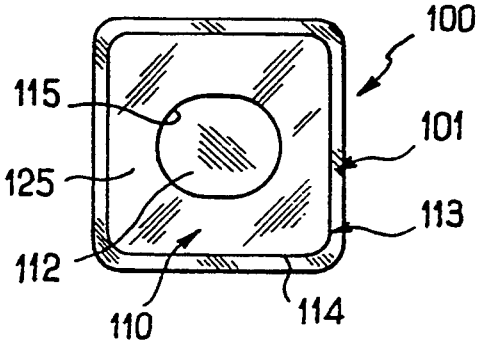
FIGS. 2 and 3 are a front view and a rear view of the above button.
Figure 3:
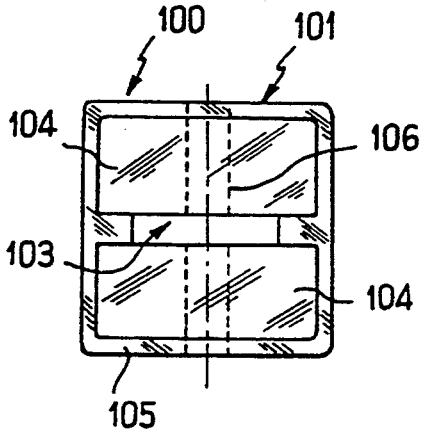

FIG. 1 shows a front panel 10 which may be the front panel of an equipment case or box on board an aircraft, constituting a boundary between outside space 21 and inside space 22 (relative to the box). Its outside or front face is referenced 11 whereas its inside face is referenced 12. The front panel 10 has a through hole 13 whose shape corresponds to the section of the corresponding button. Where the hole goes through the front panel 10, there can also be seen two cylindrical surfaces 14 which correspond to portions painted in a dark color (e.g. black) so as to define a narrow passage 15 between them. In practice, and as is commonly the case, the front panel 10 may be made from a machined block of polymethyl methacrylate, which block is successively coated in a first layer that is white in color, in a second layer that is mat black in color, and in a third layer having a desired color (which is generally blue, dark gray, or black). Markings are conventionally engraved by removing the outer two layers, so that the markings appear in white. A light source (not shown) is associated with the front panel 10 and light rays propagate within the panel as represented by arrows 20 so as to leave via the above-mentioned narrow passage 15 thus penetrating into the substance of the button in question, for the purpose of illuminating the front face thereof. The selection button 100 is constituted by a translucent body 101 having an axis X and having a front face 102 which is illuminated when the front panel 10 is itself illuminated internally.

According to an essential characteristic of the invention, the front face 102 of the button 100 is provided with a contrast piece 110 of non-translucent material, and in this case the contrast piece is received in said front face. The contrast piece 110 forms a reflecting surface 125 that provides a large amount of contrast in full sunlight relative to the front face 11 of the front panel 10, and when seen from in front (arrow 200) it delimits the outline of the front 102 of the button (as can be seen more clearly in the front view of FIG. 2). Because it is received in the front face 102 of the button, the contrast piece 110 also delimits a central zone 112 therein which is illuminated when the front panel 10 is itself illuminated internally.

The term "ring" should be understood broadly, and in particular should not be limited to a particular type of internal or external outline, providing the external outline is compatible with the front face 102 of the button and the internal outline defines a central zone 112 that is large enough to make identification easy when said central zone is illuminated. In particular, as can be seen more clearly in FIG. 2, the contrast piece 110 may have a square-shaped external outline 114 that is geometrically similar to the cross-section of the button 100, thereby defining a narrow peripheral margin 113. The contrast piece 110 also has an internal outline 115 that is rounded and in the present case is oval.

Figure 4:
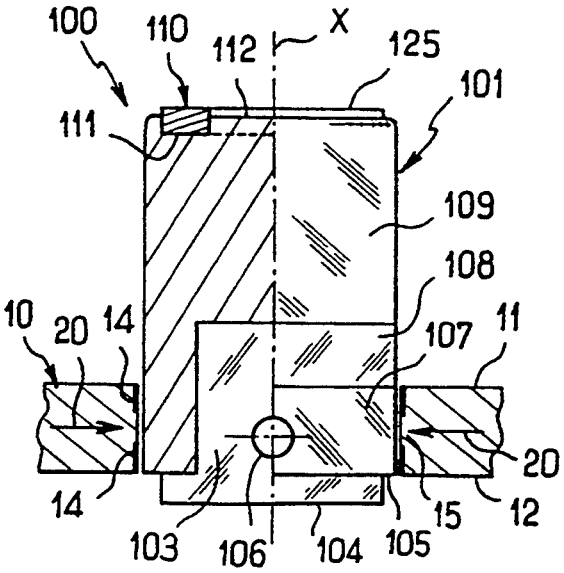
FIG. 4 is another representation of the same button comprising a half plan view and a half section view (with the section plane being perpendicular to the plane used in FIG. 1)

Thus, as can be seen more clearly in FIGS. 1 and 4, the contrast piece 110 is received in an associated groove 111 provided in the front face 102 of the button, and the contrast piece has a flat annular front face 125 that, in this case, projects slightly proud from said front face 102. The contrast piece 110 is preferably made of a material that withstands wear, both with respect to friction wear and with respect to wear over time, and its color should be as pale as possible, in particular white. It is preferable to use polytetrafluorethylene which has the advantage of being highly inert relative to ultraviolet radiation and of having a low coefficient of friction, but in a variant, any other bulk-tinted plastic material could be used such as polyamide or polyethylene. Nevertheless, polytetrafluorethylene appears to be more advantageous insofar as it presents excellent resistance to wear, and it is perceived by users as being comfortable to touch.

It would naturally be possible to fit the contrast piece 110 to a front face of a button that has no groove, or conversely to cause the contrast piece to be fully received so that its flat angular front face is flush with the front face of the button (as is the case for the variant embodiment described below with reference to FIGS. 6 to 12). Having the contrast piece received in the front face naturally presents the advantage of avoiding any risk of the contrast piece falling off, while having no ill effects on the reflecting power of the flat annular front face 125 that makes it possible to obtain a large amount of contrast relative to the front face 11 when seen in full sunlight.

The rear end of the button 100 also includes a flat notch 103 on the axis X of the button body 101 for the purpose of receiving the shaft of an associated coupling member (not shown). In conventional manner, the shaft inserted in the notch 103 is then held in place by inserting a pin through an associated transverse hole 106 formed in the button body 101. The rear face of the button body 101 is preferably painted black at its two facets 104 disposed on either side of the above-mentioned notch 103 and at its peripheral edge 105 (where the shape of the rear face of the button body will be better understood by referring to FIG. 3).

Figure 5:
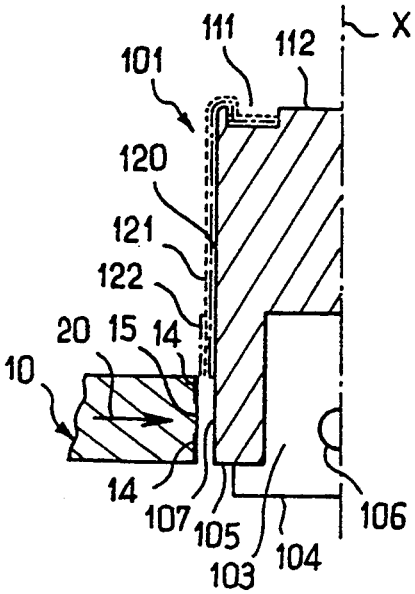
FIG. 5 is a half-section showing the body of the button without the contrast piece received therein, said body being made of a material that is translucent and the figure showing diagrammatically the successive layers of coating provided on said body.

The button body 101 is made of a translucent material, and its side surface is subdivided in this case into three successive zones: a rear zone 107 that is allowed to remain transparent, then an intermediate peripheral collar 108 which is preferably of the same color as the contrast piece 110, and finally a front portion 109 that is dark in color, in particular black or blue, with the color of this portion being preferably the same as the color of the coating on the front face 11 of the front panel 10. It is important to observe that the central zone 112 does not have any coating so as to ensure that it remains transparent, thus enabling it to be illuminated from the inside of the button body. Light rays leaving the front panel, as shown by arrows 20, penetrate into the button body 101 via the transparent rear portion thereof and can escape from said button only via the central zone 112 of its front face 102. FIG. 5 makes it easier to understand how successive layers of coating are organized on the translucent body, said layers being deposited before the associated contrast piece is installed. Apart from the central zone 112 of its front face 102 and the rear zone 107 that are to remain transparent, the outside of the button body 101 is coated with an undercoat 120 that is preferably white, and with a top coat 121 that is dark in color, in particular black or blue. The peripheral color 108 is then obtained by means of an additional coat 122 that preferably has the same color as the contrast piece that is installed subsequently. It should be observed that the groove 111 for receiving the contrast piece is likewise coated with the two above-mentioned coats 120 and 121 so as to ensure that the light diffused into the button body is conveyed solely to the central zone 112 only.

In FIGS. 1, 4, and 5, the button 100 is shown in its non-pushed-in position, i.e. in its non-selected position. When an operator presses the button (in the direction of arrow 200) so that said button moves to its selected position, then the white-painted intermediate collar 108 partially intercepts the passage 15 for light rays, thereby attenuating illumination of the central zone 112 of the button.

The nighttime contrast values that can be obtained using such a button are greater than 5, regardless of whether the button is pushed in or is not pushed in. In addition, the presence of the contrast piece 110 received in the button has the effect of reducing the illuminated area of the front face 102 of the button since it is limited to the above-mentioned central zone 112, thereby facilitating visual selection by the operator at night.

The performance of the button of the invention is naturally even more remarkable with respect to its daytime contrast in full sunlight: because of the reflecting surface 125 in the front face 102 of the button, it is possible to obtain contrast values that are considerably greater than 5 relative to a gray background and 12 relative to a black background. Unlike having a white collar as already used in prior art buttons for the purpose of facilitating identification when seen sideways in daytime, the presence of the contrast piece in the front face makes it possible to obtain contrast that is significant when measured with the means normally used for measuring contrast at a given point on an object, thereby making it possible to verify that significant contrast is indeed obtained relative to the front panel, when seen from in front and in full sunlight. In particular, the intermediate collar 108 of the button serves merely to facilitate sideways identification of a button that is far away from a front zone immediately in front of the user, given that the collar can be seen only when the button is not pushed in and cannot be seen when the button is pushed in.

A variant of the above-described selection button is now described, and here again the button is of the pushbutton type and it has a contrast piece received in its front face, however this button is also mounted rotatably so as to perform potentiometer-type adjustment, and as a result the button is round in shape. To facilitate description, the same references are retained as for the button described above whenever the members or portions concerned are identical or similar.

The button body 101 still has a transparent rear portion 107, a white-painted intermediate collar 108, and a front portion 109 which, in this case, is provided with axial fluting 109.1 for making it easier to grasp the button and rotate it about its axis X.

Figure 6:
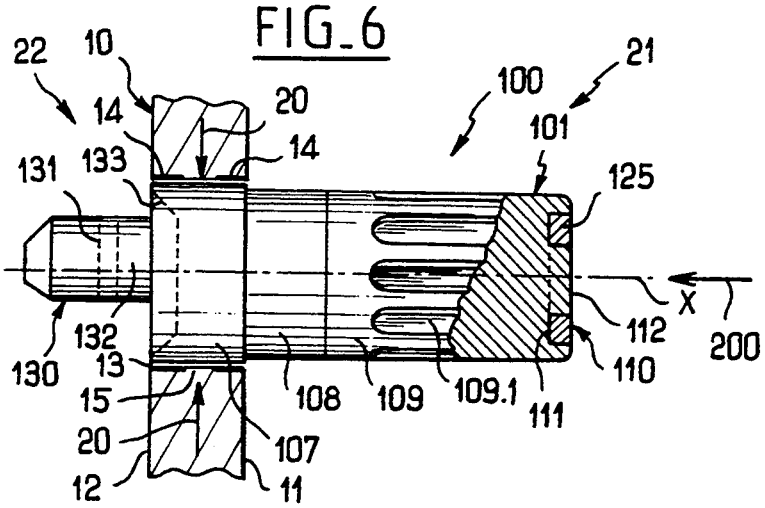
FIG. 6 shows another variant having a contrast piece received therein, comprising a pushbutton type selector button that is also rotatably mounted for potentiometer-type adjustment purposes (the button is round in shape), the contrast piece being fully integrated in the front panel of the button.
Figure 8:
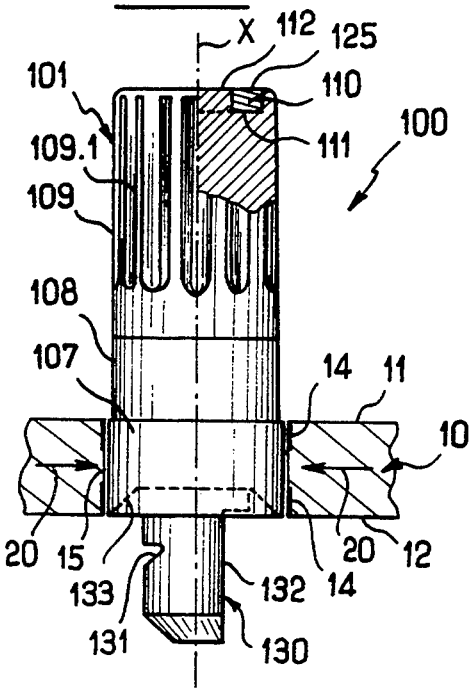
FIG. 8 shows the same button in partially cutaway plan view (the section plane being perpendicular to that used in FIG. 6)

As can be seen more clearly in FIGS. 6 and 8, the rear portion of the button body 101 is somewhat differently organized, with a shaft 130 that has a notch 131 and a flat 132 for the purpose of snap-fastening engagement with an associated coupling member (not shown).

As before, the front face 102 of the button 100 is provided with a non-translucent contrast piece 110 which forms a reflecting surface 125 that, seen from in front, provides significant contrast relative to the front panel 10 and that delimits a central zone 112 of said front face which is illuminated whenever said front face receives internal illumination. It may be observed that the contrast piece 110 is fully received in this case in the groove 111, such that the flat annular front face 125 of said piece is flush with the front face 102 of the button. By providing an annular front face that is flush, the operator may lose a certain amount of finger feel, however a significant advantage is obtained insofar as a fully-received contrast piece makes the front face of the button insensitive to collecting dirt.

As can be seen in FIGS. 6 and 8, the rear portion 107 of the button body 101 has a conical surface 133 which is preferably coated in white paint so as to obtain a reflecting effect for light rays that enter the transparent portion 107 sideways, thereby ensuring that the light diffuses properly to the central zone 112 in the front face 102 of the button.

Figure 7:
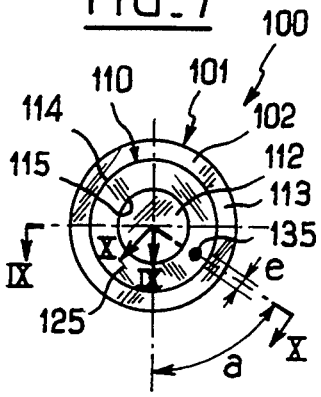
FIG. 7 is an end view of the above button and serves to show the angular reference mark provided on the received contrast piece.
Figure 9:
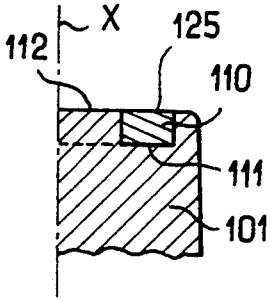
FIGS. 9 and 10 are fragmentary sections on IX—IX and on X—X of FIG. 7.
Figure 10:
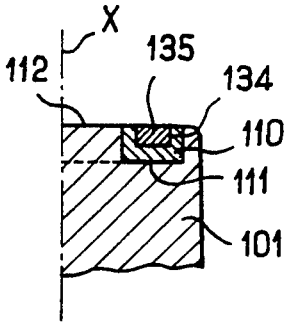
Figure 12:
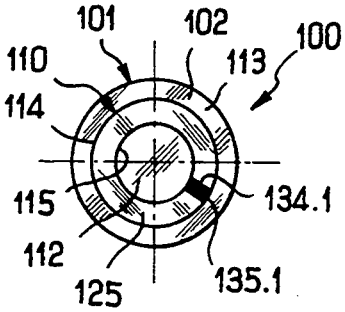
FIG. 12 is similar to FIG. 7 and shows a variant way of marking angular position, and in this case the hole formed in the contrast piece is replaced by a radial split.

The contrast values obtained by such a button when seen from in front are entirely comparable to those obtained with a square selector button as described above, and this applies both at night and in full sunlight. However, since the button is also designed to provide potentiometer-type adjustment by being rotated about its axis X, it is also necessary to provide means for making it easy to identify the angular position of the button. FIG. 7 and the two associated sections of FIGS. 9 and 10 show that the contrast piece 110 is provided with a spot hole 134 that receives a small volume of dark filler material 135 (e.g. black material) for making it easier to identify the angular position of the button 100. In practice, the small volume is merely a drop of paint, and its color is preferably identical to that already provided on the side portion 109 of the button body and on the front face 11 of the front panel 10. For example, the black spot 135 may be positioned at an angle a that is equal to 60° relative to the vertical plane including the axis X of the button when said button is in abutment in a minimum position. The diameter of the black spot, written e, may be about 1 millimeter, for example. In a a variant, as shown in FIG. 12, the contrast piece 110 may be split radially at 134.1 where it likewise receives dark filler material 135.1, in particular black material which would then appear as a radial line. In any event, the angular position of the button should be identifiable in a manner that remains sufficiently discreet so as to avoid attenuating the reflecting nature of the flat annular surface 125 of the contrast piece 110.

Figure 11:
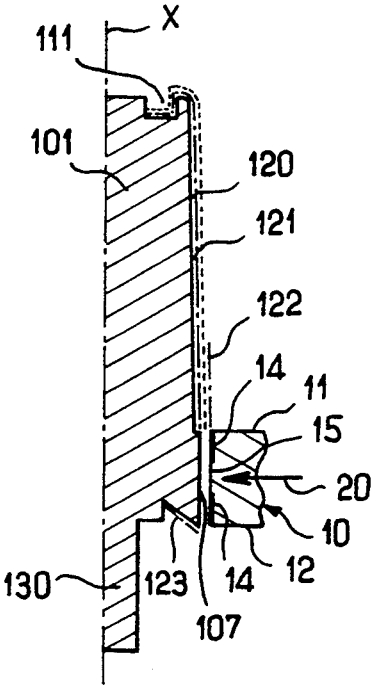
FIG. 11 is a half-section showing the body of the button (which is made of a translucent material) without its contrast piece, and with successive layers of coating that are provided on the body being represented diagrammatically.

In FIG. 11, which is comparable to FIG. 5, it can be seen that the translucent body 101 is coated in successive coats apart from the central zone 112 of its front face 102 and the rear zone 107 that must remain transparent. A pale undercoat 120 that is also applied to the groove 110 and that is preferably white in color, is deposited first, and then said undercoat is covered with a dark top coat 121, that may be black or blue, in particular. The intermediate peripheral collar 108 is obtained by a localized coating 122 of the same color as the contrast piece 110. It may also be observed that a white coating layer 123 is present in association with the above-mentioned conical portion 133.

Here again, the contrast piece 110 has an external outline 114 of the same shape as the front face 102 of the button, i.e. circular in this case, and said piece also has a rounded internal outline 115, in this case likewise circular, such that the contrast piece 110 is constituted in this case by an accurately circular annulus. The comment made above concerning the material and the color used for making the contrast piece 110 naturally continue to apply with a potentiometer-type adjustment and selection button as shown in FIGS. 6 to 12.

A button has thus been provided suitable for selection and/or adjustment and having a structure that makes it possible to obtain satisfactory contrast values both at night and in full sunlight. The above description shows that the contrast performance of a button of the invention is independent of the shape of the button and is also long-lasting. Finally, the same performance can be achieved if the button is not of the pushbutton type (i.e. if it serves for potentiometer-type adjustment only).

A variant embodiment of the invention is described below in which the contrast piece is no longer in the form of an insert received in the front face of the button.

Figure 13:
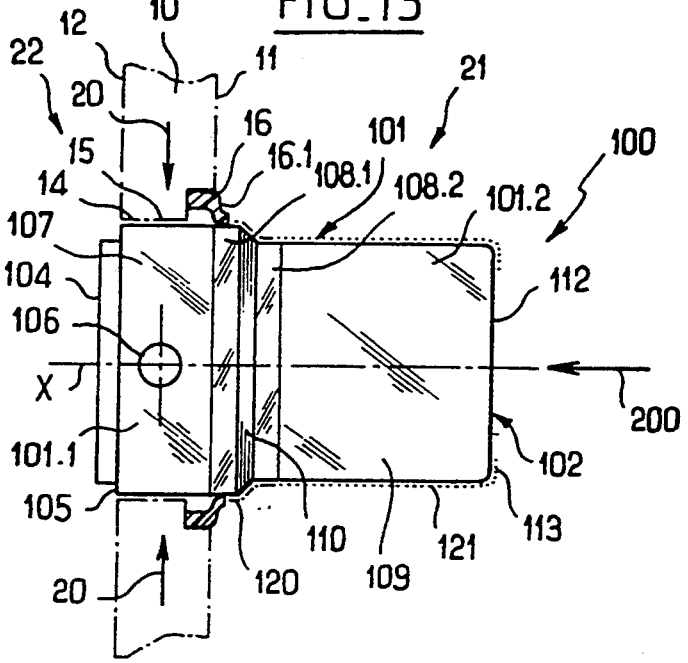
FIG. 13 is a plan view of another embodiment of the invention, in this case for a button of square section, in which the contrast piece is no longer received in the front panel of the button but is constituted by a white-painted connection surface (in this case in the form of a chamfer) disposed between two geometrically similar portions of the body of the button.

Thus, FIG. 13 shows a button 100 (of square section in this case) whose body 101 is made up of two portions 101.1 and 101.2 of geometrically similar sections: the rear portion 101.1 is the portion having the larger section and it passes through the front panel 10 (represented in this case by chain-dotted lines). In this case, the front panel 10 is shown as constituting a variant in which a washer 16 is provided to define the front of the through opening associated with the button, said washer being terminated by a contact lip 16.1 (in practice it will be possible to use a metal washer, of brass, having silicone molded thereover): the lip 16.1 which rubs against the button throughout its movement thus prevents light from leaking out and prevents ingress of dust or liquid.

The connection surface constituting the contrast piece 110 may constitute a chamfer (as it does in this case) or it may constitute a rounded fillet (in a variant that is not shown): in any event the contrast piece is coated with a white top coat.

When the button is not pushed in (position of FIG. 13) the contrast piece 110 is visible and its reflecting surface provides the desired contrast when seen from in front (along arrow 200). In addition, still in front view, the contrast piece 110 outlines the front face 102 of the button as can be seen clearly from FIG. 14.

When the button 100 is pushed in, the contrast piece 110 goes past the washer 16 and is therefore no longer visible. Contrast is then given by the front face 102 of the button being illuminated. It may also be advantageous to provide a peripheral collar on the button body having the same color as the contrast piece 110 (like the collar 108 in the preceding variants), but disposed in the immediate vicinity of the contrast piece 110, and being likewise visible when the button is not pushed in, and being hidden when said button is pushed in. In particular, in the present case, the peripheral collar comprises two portions 108.1 and 108.2 that exist on either side of the contrast piece 110.

Figure 14:
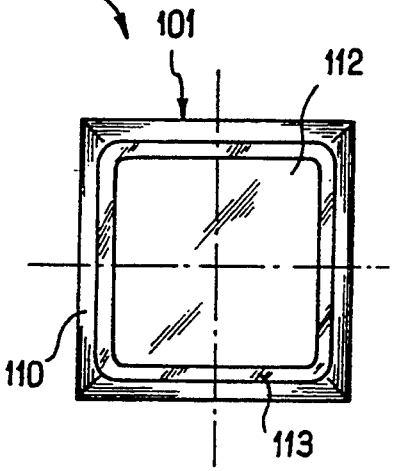
FIG. 14 is a front view of the button showing that when seen from in front the connection surface delimits the outline of the front panel of the button.

Unlike the preceding cases, this pair of collar portions serves only for identification from the side, since the contrast piece acts on its own in front view (FIG. 14).

There are thus in succession: a translucent rear portion 107, a white intermediate portion that is stepped 108.1, 110, 108.2; and a front portion 109 that is dark in color, e.g. black, with the dark paint extending to the narrow peripheral margin 113 of the front face 102 delimiting the central zone 112 that is suitable for being illuminated. The white coat 120 and the dark coat 121 are represented diagrammatically.

As will easily be understood, such a contrast piece defined by a connection surface between two geometrically similar portions of the button body could be implemented on buttons of different cross-section, e.g. a round section.

Figure 15:
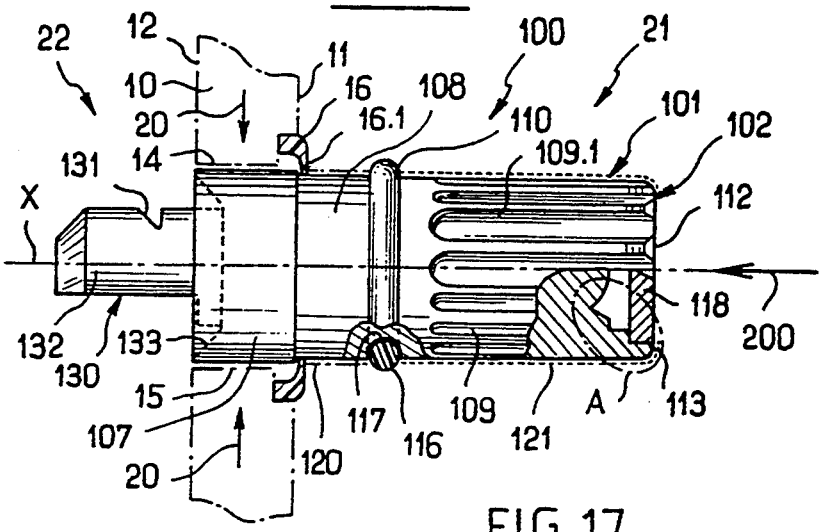
FIG. 15 shows a variant of the above embodiment, in this case for a round selector button that is rotatably mounted for potentiometer-type adjustment, and having a contrast piece which is defined by a toroidal ring surrounding the body of the button and projecting from the side face thereof.

FIG. 15 is similar to FIG. 8 and shows another variant of the radially-projecting contrast piece.

In this case, the button 100 is round since it constitutes a rotatably mounted button for potentiometer-type adjustment. The rear portion of this button is identical to that of the button described above with reference to FIG. 8.

The essential difference lies in having a ring 116 that surrounds the button body 101 and that projects from the side face of the body. The ring 116 is white in color and is reflective, so that when seen from in front (arrow 200) it presents a clearly visible front annular face that provides the desired contrast.

Since this button is round in section, the ring 116 is toroidal. It is preferably partially received in an associated circumferential groove 117 of the body 101: in this case the ring is round in section and the outline of the groove is semicircular. It is preferable to use a silicone elastomer for making this ring.

A peripheral collar 108 is similarly provided in the direct vicinity of the ring 116, and is of the same color.

As for the button described above, the ring 116 and the collar 108 are visible only when the button 100 is not pushed in.

Figure 16:
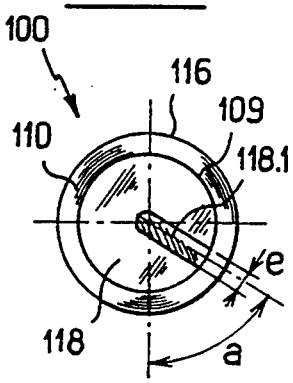
FIG. 16 is an end view of the above button, showing the angle mark provided on a insert received in the front panel of said button.

The front view of FIG. 16 clearly shows the surface of the ring 116 that forms the contrast piece 110 for the purpose of obtaining the desired contrast in front view.

Naturally such a ring could be installed on the above-described button of square section, as a replacement for the connection chamfer.

As before, there can be found in succession: a translucent rear portion 107; a white intermediate portion 108 having the projection white ring 116 (white coat 120); and a front portion 109 that is dark in color, e.g. black (dark coat 121), the dark paint then extending to the narrow peripheral margin 113 surrounding the insert 118 received in the front face of the button.

Figure 17:
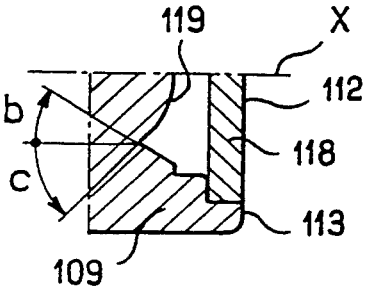
FIG. 17 is a fragmentary section showing a detail A of FIG. 15 on a larger scale.

FIGS. 15 to 17 also show that the front face of the button is implemented in the form of a transparent insert 118 received in the front face of the button. As can be seen in FIG. 16, the insert has a radial groove 118.1 that receives a pale filler material, in particular white material, for making it easier to identify the angular position of the button (as before, the line width e could be 1 mm, and it could be at an angle a of 60° when the button is in its minimum abutment position). FIG. 17 shows more clearly how the front 119 of the body 101 is shaped with a central dome and a V-shaped groove defined by angles b and c which are respectively equal to 30° and to 45°, in this case.

The selection and/or adjustment button of the invention is particularly advantageous for use in aviation, being mounted on the front panel of a box disposed in an aircraft cabin, e.g. for selecting communications channels, and/or for adjusting the corresponding volume. Naturally, such use merely constitutes one possible example and the invention will find other fields of application wherever there is a need for significant contrast both at night and under full sunlight.

The invention is not limited to the embodiments described above, but on the contrast extends to any variant that uses equivalent means for reproducing the essential characteristics specified above.

We claim:

1. A selection and/or adjustment button mounted on a front panel of an equipment box on board an aircraft, said button being constituted by a translucent body having a front face that is illuminated when the front panel is illuminated internally, wherein said button is provided with a non-translucent contrast piece, said piece forming a reflecting front surface that provides significant contrast relative to the front panel in full sunlight, and that delimits the front face of the button when seen from in front; said contrast piece being constituted by a connection surface between two portions of the translucent body that are geometrically similar in section, with a smaller section portion extending forwards, said connection surface being coated in a white top coat, said piece being visible when the button is not pushed and being substantially hidden when said button is pushed in;

wherein the contrast piece is of a pale color white, and the body of the body has, in the immediate vicinity of the contrast piece, a peripheral collar of the same color as the contrast piece, said collar being visible when the button is not pushed in and being hidden when said button is pushed in.

2. A button according to claim 1, wherein the translucent body is externally coated apart from a central zone of its front face in a white undercoat and in a dark top coat, the colors of said coat being selected in the group including black, gray and blue.

3. A button according to claim 1, wherein the connection surface constituting the contrast piece constitutes a fillet or a chamfer.

4. A button according to claim 1, wherein the peripheral collar comprises two portions on respective sides of the contrast piece.

5. A button according to claim 1, wherein said pale color is white.

* * * * *